US006431382B1

(12) United States Patent
Li

(10) Patent No.: US 6,431,382 B1
(45) Date of Patent: Aug. 13, 2002

(54) BEVERAGE CONTAINER HAVING A SELF-CONTAINED POP-UP DRINKING STRAW OR TUBE

(76) Inventor: Tianfu Li, 1103 Winthrop Dr., Troy, MI (US) 48083

( * ) Notice: Subject to any disclaimer, the term of this patent is extended or adjusted under 35 U.S.C. 154(b) by 0 days.

(21) Appl. No.: 09/576,933

(22) Filed: May 24, 2000

(51) Int. Cl.[7] ..... B65D 83/00

(52) U.S. Cl. ..... 215/388; 220/708; 220/709

(58) Field of Search ..... 215/388, 358, 215/355; 220/705, 707, 708, 709, 710, 367.1

(56) References Cited

U.S. PATENT DOCUMENTS 2,175,735 A * 10/1939 Banks ..... 215/388 X
2,724,536 A * 11/1955 Pugh, Sr. ..... 215/388
3,220,587 A * 11/1965 Griffin et al. ..... 215/388
3,226,001 A * 12/1965 Sequieira ..... 215/388 X
3,291,331 A * 12/1966 Grisham et al. ..... 215/388 X
3,776,458 A * 12/1973 Chunga, Sr. ..... 215/388
4,744,477 A * 5/1988 Wofford ..... 215/388 X
4,925,040 A * 5/1990 Wang ..... 215/388 X
5,160,058 A * 11/1992 Ahn ..... 215/388 X
5,244,112 A 9/1993 Murphy et al.
5,253,779 A 10/1993 Lee
5,431,297 A 7/1995 Rosello
5,547,103 A 8/1996 Murphy et al.
5,975,340 A 11/1999 Cornell et al.
6,000,573 A 12/1999 Murphy et al.
6,006,952 A 12/1999 Lucas
6,116,446 A * 9/2000 Haughton et al. ..... 215/388 X
6,142,326 A * 11/2000 Cornell et al. ..... 215/388
6,158,611 A * 12/2000 Cornell et al. ..... 215/388 X
6,196,413 B1 * 3/2001 Tung ..... 215/388 X

* cited by examiner

*Primary Examiner*—Lee Young
*Assistant Examiner*—Tri M. Mai
(74) *Attorney, Agent, or Firm*—Frank G. McKenzie

(57) ABSTRACT

A beverage container holding a drinking straw having an upper portion located in an insert that is fixed to an inner surface of the container and directs the straw toward an opening through an neck, and a removable cap having a plug that engages the upper end of the straw and draws the straw outward through the opening as the cap is removed.

11 Claims, 4 Drawing Sheets

BEVERAGE CONTAINER HAVING A SELF-CONTAINED POP-UP DRINKING STRAW OR TUBE

BACKGROUND OF THE INVENTION

1. Field of the Invention

This invention relates to the field of beverage containers, more particularly to such containers having a drinking straw stored in the container.

2. Description of the Prior Art

U.S. Pat. No. 5,160,058 discloses a drinking straw contained in a bottle, a floating ball for lifting the straw when the cap is removed, a ring, and a water soluble washer, which dissolves in the fluid contained in the bottle. As the fluid level falls, the float lifts the straw to a progressively lower level.

U.S. Pat. No. 5,975,340 describes a float assembly for raising a straw in a beverage can through a aperture that cannot be reclosed. The straw is axially extendible, and the assembly requires a positioning mechanism. U.S. Pat. No. 6,000,573 describes another float device for raising a straw in a beverage can through a opening in the can top. The assembly includes a buoyant member integral with the straw that secures the straw to the can. Similarly U.S. Pat. No. 5,431,297 describes a container having a straw with a float attached to lift the straw through an opening in the container top.

U.S. Pat. No. 5,253,779 discloses a beverage can that carries a pop-up straw that includes inner and outer telescoping drinking straws. The inner straw has a coil at one end for raising the inner straw relative to the lower straw and through the top of the can when the closure is open. The can cannot be reclosed, and there is no provision for restoring and holding the straw in the can after use.

U.S. Pat. No. 6,006,952 describes a flexible sports bottle having a lid that allows air flow in one direction through an orifice offset from a liquid flow orifice. Tipping the bottle over closes the orifices to be sealed by a cap retained on a straw.

It is preferable that a beverage container present the drinking straw to the consumer outside the container but without need for a float that occupies space within the container. Floats of the type known heretofore displace the product within the container and require larger containers than otherwise would be needed for the standard volume of product that the consumer expects.

SUMMARY OF THE INVENTION

It is an object of this invention to provide a beverage container that contains a straw when the container is filled and sealed at the processing plant where it originates, the straw providing consumers a convenient way to drink from the container. It is another object to provide a container having a drinking straw that is extendible and drawn automatically and repeatedly from the container as a cap at the top of the container is removed from its closed position. It is yet another object to provide a container having a drinking straw that can be easily returned to the container and the container resealed after use without need to manually touch the straw.

In realizing these objects and advantages, an assembly for use in combination with a beverage container according to the present invention includes a cap removably fixed to an opening in the container, the cap having a plug projecting into the container; an insert located within the container, the insert held in position on an inner surface of the container, defining a guide means directed toward the opening; and a drinking straw located within the container, passing through the guide means, and having a first end fitted within and engaging the plug such that removal of the cap from the container draws the first end of the straw outward from the container through the opening.

DESCRIPTION OF THE PREFERRED EMBODIMENT

Figure 2:
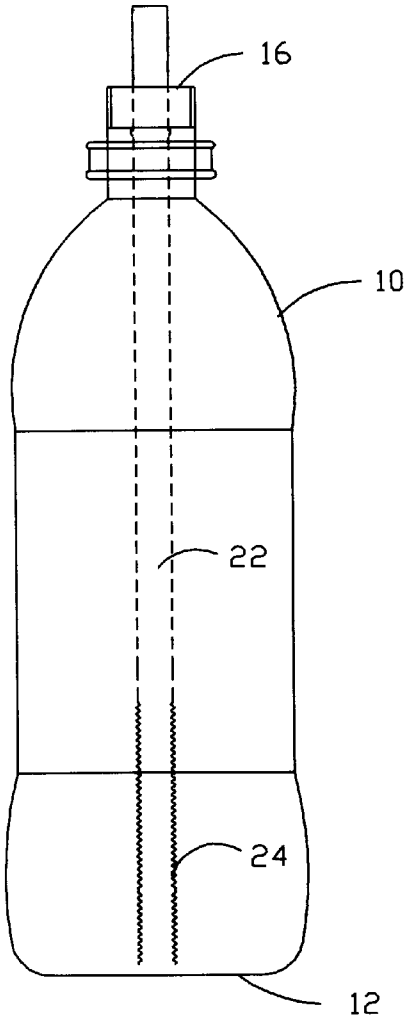
FIG. 1 and FIG. 2 are side views of alternate embodiments of this invention showing a container and a straw extending through an opening in the container.
Figure 1:
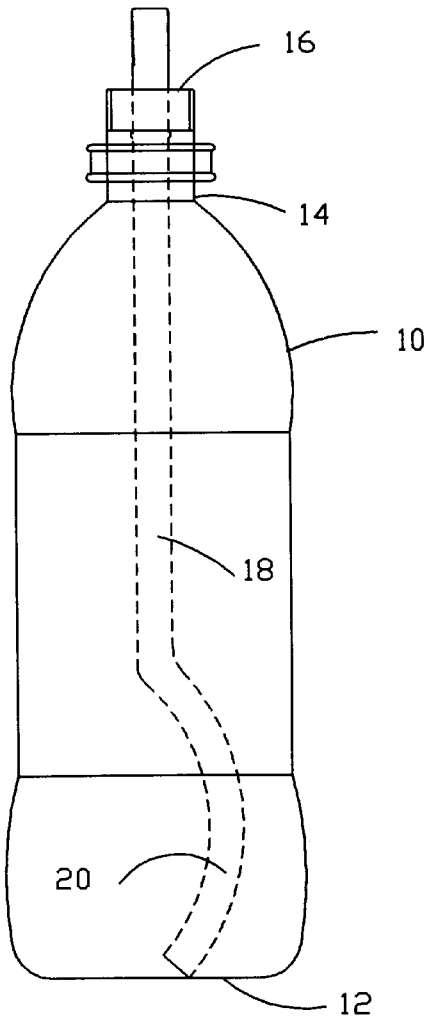

Referring first to FIGS. 1 and 2, a thin walled container 10 includes side walls, a closed bottom 12, a neck 14 located at the top of the container and connecting the interior of the container and an opening 16. FIG. 1 shows a straw 18 located in the container and extending outward through the neck 14 and opening 16. The lower end of the straw is formed with an antenna shape 20, which can be elastically deformed by pressing the straw into the container, whereby upon release the straw is urged upward through the neck to the extended position shown in FIG. 1. Alternatively, the straw 22 of FIG. 2 is formed with a pleated surface 24 that can be compressed by an axially directed force applied to the straw. The straw can be stored entirely within the container, but the straw is urged upward through the neck to the extended position of FIG. 2 upon release of the force that contracts the straw. The straw can be bent repeatedly at the pleated region in a lateral direction to make the straw more accessible to the consumer and thereafter straightened and shortened for return to the container.

Figure 3:
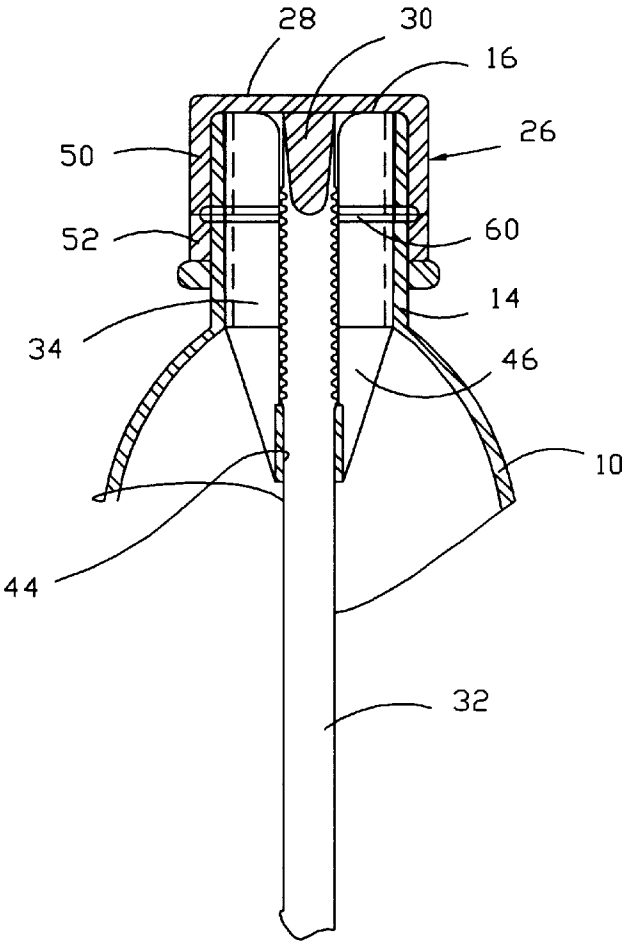
FIG. 3 is a side view of the container, straw and cap in the assembled condition.

FIG. 3 shows the container 10 having a neck 14 connecting the body of the container with an opening 16 located at the end of the neck. Cap 26 closes the opening with a disc portion 28 formed with a plug 30 that extends axially inward and is adapted to engage the interior surface of the straw 32 at the upper end of the straw. Preferably, the outer surface of the neck 14 of the container is formed with screw threads that are engaged with internal screw threads formed on the inner surface of cap 26.

Figure 4:
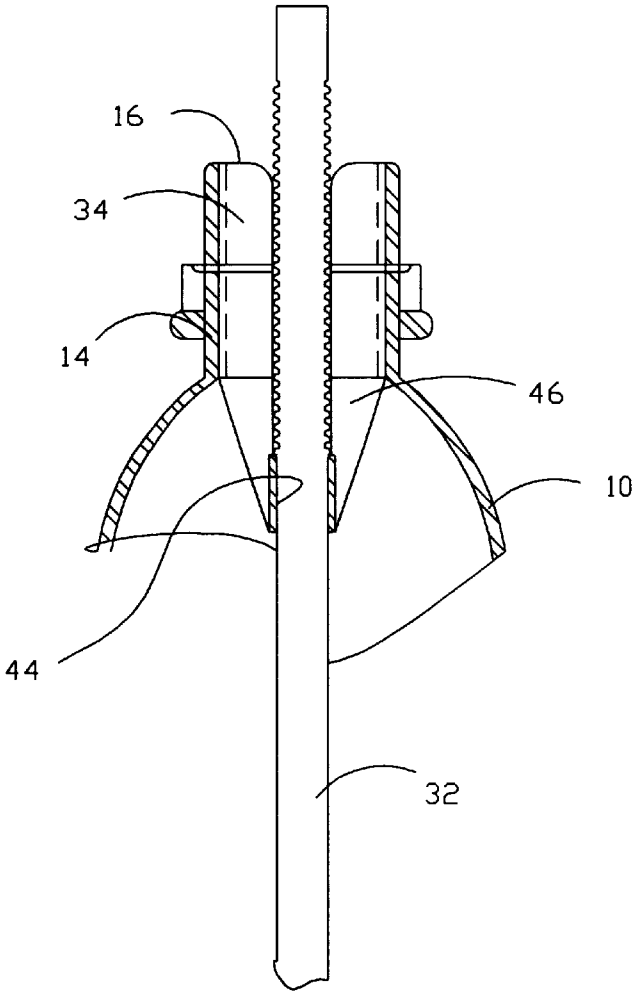
FIG. 4 is a side view of the container and straw showing the cap removed and the straw partially extended.

An insert 34, includes an exterior surface that engages the inner surface of neck 14, this engagement holding insert 34 in position of the neck 14. Preferably the insert is injection molded apart from the container, or it can be molded integrally with the container. Straw 32 extends upward through insert 34 into engagement with the plug 30 on cap 26. The straw FIG. 4 shows the container assembly with the cap removed and the straw 32 partially extended axially through the insert, neck and opening, and extending beyond the opening.

Figure 6:
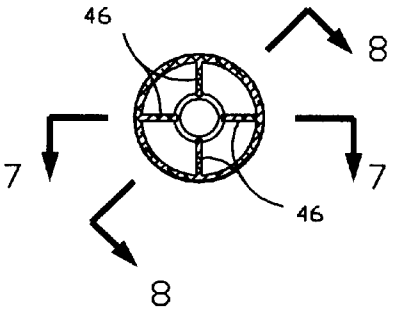
FIG. 6 is a cross section taken at plane 6—6 of FIG. 5.
Figure 8:
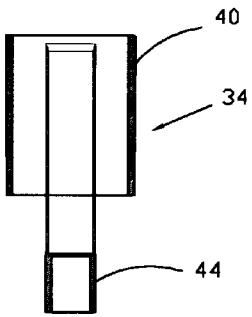
FIG. 8 is a cross section taken at plane 8—8 of FIG. 6.
Figure 5:
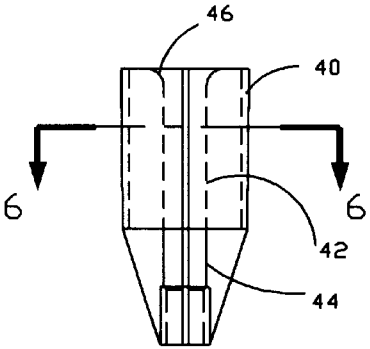
FIG. 5 is a side view of an insert forming a part of the assembly of FIG. 3.
Figure 7:
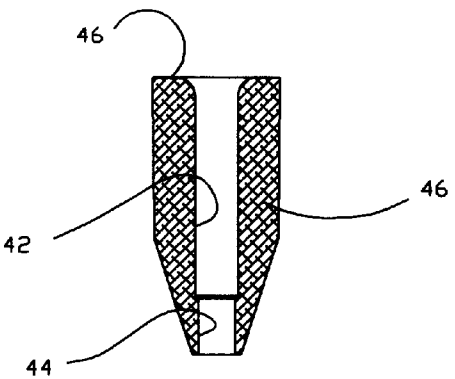
FIG. 7 is a cross section taken at plane 7—7 of FIG. 6.

Referring now to FIGS. 5–7, the insert 34 includes a circular cylindrical portion 40 sized to fit with a slight interference against the inner surface of the neck 14. The insert includes a first, larger diameter circular cylindrical guide 42 extending partially along the axis of insert 34, and a second smaller diameter guide 44, coaxial with the first guide and located immediately below it. The guide 42 is sized to permit the straw to be stored within the container after being used to drink beverage from the container, yet guide 42 prevents bending of the straw as the straw is compressed during its return to the stored position. Four webs 46, connecting surface 40 and guides 42 and 44, are angularly displaced mutually and extend radially and axially within the annular space between the guides 42, 44 and cylindrical surface 40. The diameter of the first guide is about 1 mm larger than the diameter of the second guide 44.

The upper end of guide 42 terminates with a fillet radius that facilitates entry of the plug 30 of cap 26 into the straw and guide 42 during assembly and reentry of the plug into the straw as the cap is returned to the position of FIG. 1 following use.

Figure 9:
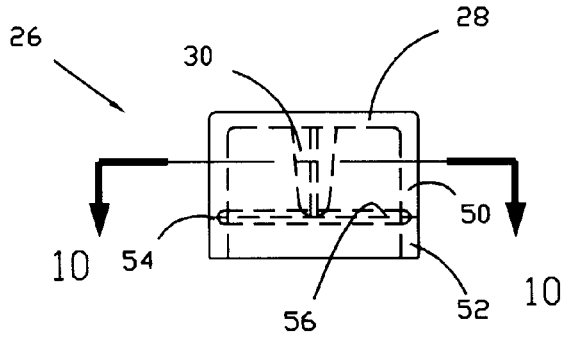
FIG. 9 is a side view of the container cap.
Figure 10:
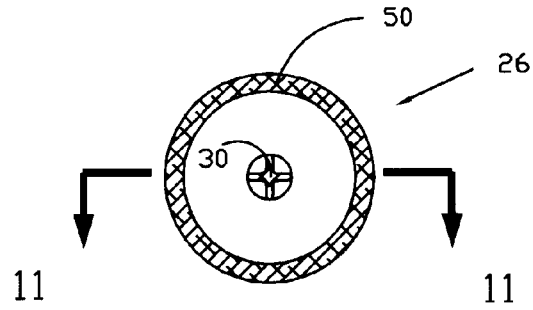
FIG. 10 is a cross section taken at plane 10—10 of FIG. 9.
Figure 11:
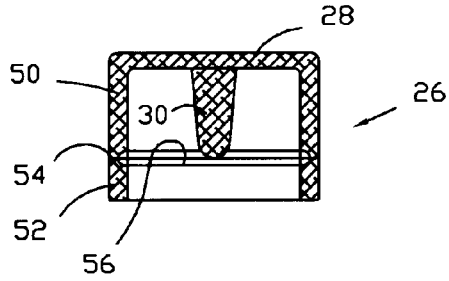
FIG. 11 is a cross section taken at plane 11—11 of FIG. 10.

FIGS. 9–11 show the details of a cap suitable for use with the container. The cap 26 is formed with internal screw threads sized and adapted to engage external screw threads on the outer surface of the neck 14 of container 10. The disc 28 portion of the cap closes the opening 16 at the upper end of the neck, and supports a plug 30, which is centrally located about the axis of the container, straw 32 and the guide 42.

The cap includes an upper cylindrical portion 50, a lower cylindrical portion 52, located immediately below portion 50 and releasably connected to portion 50 by a scored surface 54, which is adapted to break away when the upper portion of the cap is turned relative to the lower portion 52. The cap is also formed with an annual recess 56. The neck includes an annular stop surface 60 surrounding the cylindrical surface of the neck 14 and located within recess 56. Therefore, when the upper portion 50 of cap 26 is rotated relative to the lower portion 52 to remove the cap from the container, the lower portion 52 is prevented from moving upward due to its contact with the stop ring 60. Continued rotation of the cap portion relative to portion 52 causes the scored surface 54 to break away, thereby permitting the upper portion of the cap to be removed from the neck, and the lower portion is retained on the neck below the ring 60.

After the cap portions 50, 52 mutually separate and the cap is screwed off the neck, the cap is free to be lifted from the container. As the cap is removed, the frictional engagement of the plug and straw draws the upper end of the straw out of the container causing the pleated upper portion of the straw to extend axially from its compact condition while the container cap is on the neck. Then the user can easily grasp the straw and drink fluid from the container through the straw.

In an alternative arrangement, the straw may include upper and lower portions that fit one within the other in a telescopic arrangement, such as that shown and described in U.S. Pat. No. 5,975,340. In this case, removal of the cap from the container neck draws the smaller straw portion upward through the larger straw portion, through the insert, neck and the container opening so that it extends at a convenient position for the user to drink fluid from the container through the straw. Thereafter, in either case, the straw is readily returned to the container by reinserting the plug in the straw end and screwing the cap onto the neck.

Although the form of the invention shown and described here constitutes the preferred embodiment of the invention, it is not intended to illustrate all possible forms of the invention. Words used here are words of description rather than of limitation. Various changes in the form of the invention may be made without departing from the spirit and scope of the invention as disclosed.

What is claimed is:

1. An assembly for use in combination with a beverage container, comprising:

a cap removably fixed to an opening in the container, the cap having a plug projecting into the container;

a neck surrounding the opening, the neck having an inner surface;

an inset located within the container, the insert held in position on an inner surface of the container and defining a guide means directed toward the opening, the insert including a first surface engaging the inner surface of the neck, the guide means including a first guide surface substantially aligned axially with the first surface, surrounded by and spaced radially from the first surface, having an inner surface surrounding the straw and permitting a portion of the straw length to be drawn through the first guide surface toward the opening;

a second guide surface substantially aligned axially with the first surface, having an inner surface surrounding the straw and preventing the straw from passing through the second guide surface toward the opening;

the insert further comprises webs mutually connecting the first surface of the insert, the first guide surface and second guide surface, the webs mutually spaced angularly about a central axis of the insert; and a drinking straw located within the container, passing through the guide means, and having a first end fitted within and engaging the plug such that removal of the cap from the container draws the first end of the straw outward from the container through the opening.

2. The assembly of claim 1 wherein:

the container defines a neck surrounding the opening, an outer surface of the neck formed with a stop surface;

the plug is substantially aligned with the guide means; and the cap further includes a first part surrounding a first portion of the neck located between the opening and the stop surface, the first portion having an upper cylindrical surface removably fixed by screw threads to the outer surface of the neck and a disc covering the opening, a second part surrounding a second portion of the neck located on the opposite side of the stop surface from the first portion of the neck, the second part located for contact with the stop surface, the first and second parts joint mutually along a scored parting surface, thereby enabling the first and second parts to break free as the first part is twisted relative to the neck; and an annular recess surrounding the stop surface, and aligned with the scored parting surface.

3. The assembly of claim 2 wherein the plug of the cap depends from an inner surface of the disc, engages an inner surface of the first end of the straw with frictional contact sufficient to draw the first end of the straw outward from the container through the opening as the cap is removed from the opening, and to permit the straw and plug to disengage mutually thereafter.

4. The assembly of claim 1 wherein the straw further comprises:

a first axially extendible portion including the first end, fitted within and engaging the plug, removal of the cap from the container axially extending the first portion and drawing the first end of the straw outward from the container through the opening;

a second portion having an axial end connected to an adjacent axial end of the first portion.

5. The assembly of claim 1 wherein the first portion of the straw is pleated and expandable axially in response to axial force applied to the straw as the cap is removed from the container.

6. The assembly of claim 4 wherein the first portion of the straw is telescopically fitted within the second portion and extends along a length of the second portion, the first portion being drawn axially from the second portion in response to axial force applied to the straw as the cap is removed from the container.

7. The assembly of claim 1 wherein the straw further comprises:

a first axially extendible pleated portion including the first end, extending through the first guide surface, fitted within and engaging the plug, removal of the cap from the container axially extending the first portion and drawing the first end of the straw outward from the container through the opening;

a second portion having an axial end connected to an adjacent axial end of the first portion, fitted within the second guide surface, and prevented from being drawn through the second guide surface as the cap is removed from the container.

8. An assembly for use in combination with a beverage container, the cap having a plug projecting into the container;

an insert located within the container, the insert located on an inner surface of the container having a guide surrounding the straw and substantially aligned with the plug, the guide permitting a portion of a drinking straw to be drawn toward the opening and preventing the entire straw from passing through the guide toward the opening, the insert further comprising webs mutually spaced angularly about a central axis of the insert, connecting and spacing the guide from the container; and a drinking straw located within the container, passing through the guide, having a first axially expandable portion fitted within and engaging the plug, a second portion having an axial end connected to an adjacent axial end of the first portion, whereby removal of the cap from the container draws a first end of the first portion of the straw outward from the container through the opening.

9. The assembly of claim 8 wherein the first portion of the straw is pleated and expandable axially in response to axial force applied to the straw as the cap is removed from the container.

10. The assembly of claim 8 wherein the first portion of the straw is telescopically fitted within the second portion and extends along a length of the second portion, the first portion being drawn axially from the second portion in response to axial force applied to the straw as the cap is removed from the container.

11. The assembly of claim 8 wherein the guide prevents the straw from bending as the straw is returned to its stored position within the beverage container.

* * * * *